US005772414A

United States Patent [19]

Kaneko

[11] Patent Number: 5,772,414

[45] Date of Patent: Jun. 30, 1998

[54] PUMP HEAD PRESSURE EQUALIZER WITH BIASING MEMBER LIMITED MOVEMENT DIAPHRAGM

[75] Inventor: Yutaka Kaneko, Wheeling, Ill.

[73] Assignee: Tetra Laval Holdings & Finance, S.A., Buffalo Grove, Ill.

[21] Appl. No.: 789,150

[22] Filed: Jan. 24, 1997

[51] Int. Cl.[6] ..... F04B 11/00

[52] U.S. Cl. ..... 417/540; 138/30

[58] Field of Search ..... 417/540, 549; 138/30; 222/250, 309, 340, 341

[56] References Cited

U.S. PATENT DOCUMENTS

| | | | |
|---|---|---|---|
| 841,791 | 1/1907 | Lemp . | |
| 2,265,971 | 12/1941 | Paul et al. . | |
| 2,779,290 | 1/1957 | Wiegers | 103/39 |
| 2,810,496 | 10/1957 | Gray | 222/254 |
| 2,871,870 | 2/1959 | Peters | 137/207 |
| 3,141,584 | 7/1964 | Wing | 222/309 |
| 3,333,597 | 8/1967 | Sullivan | 137/102 |
| 3,563,275 | 2/1971 | Sombardier | 138/30 |
| 3,757,825 | 9/1973 | Givens et al. | 138/26 |
| 3,851,661 | 12/1974 | Fernandez | 417/40 |
| 4,091,969 | 5/1978 | Easter et al. | 222/309 |
| 4,160,461 | 7/1979 | Vataru et al. | 137/337 |
| 4,174,056 | 11/1979 | Loeffler | 222/341 |
| 4,264,287 | 4/1981 | Ishida et al. | 417/540 |
| 4,431,026 | 2/1984 | Fehrenbach et al. | 137/510 |
| 4,594,059 | 6/1986 | Becker | 417/439 |
| 4,942,984 | 7/1990 | Miller | 222/309 |
| 5,036,879 | 8/1991 | Ponci | 137/496 |
| 5,102,311 | 4/1992 | Lambeck | 417/540 |
| 5,353,840 | 10/1994 | Paley et al. | 138/31 |

*Primary Examiner*—Charles G. Freay
*Attorney, Agent, or Firm*—Welsh & Katz, Ltd.

[57] ABSTRACT

A pressure equalizer for use with a reciprocating pump provides a liquid accumulation region to facilitate precise control over the amount of liquid discharged from the pump, and provides a short duration pressure spike to facilitate complete discharge of the liquid from the pump and associated components. The equalizer includes a housing mountable to the pump, in fluid communication with the pump internals. A variable volume assembly, including an isolation member, such as a flexible diaphragm, is carried by the equalizer housing and is in fluid communication with the pump. The diaphragm is adapted to expand outwardly and contract inwardly in conjunction with an increase and a decrease in pressure in the pump. Each the outward expansion and inward contraction are within a predetermined, preset range of movement. The equalizer includes a retaining member which is engageable with the diaphragm, and at least one biasing element positioned on the retaining member, operably connected to the diaphragm. The biasing element is adjustable to set the outward expansion range of movement of the diaphragm, and the inward contraction range of movement of the diaphragm. The diaphragm expands within the preset range of movement in response to an increase of pressure in the pump to define the accumulation region and to accumulate a predetermined amount of liquid therein. The diaphragm contracts within the preset range of movement in response to a decrease of pressure in the pump to discharge the accumulated liquid therefrom.

21 Claims, 4 Drawing Sheets

PUMP HEAD PRESSURE EQUALIZER WITH BIASING MEMBER LIMITED MOVEMENT DIAPHRAGM

FIELD OF THE INVENTION

This invention relates to a pressure equalizer for a reciprocating pump. More particularly, the invention relates to a variable volume arrangement having a biased isolation member for equalizing the pressure across the head of a reciprocating pump during the various phases of the pumping cycle.

BACKGROUND OF THE INVENTION

Positive displacement-type pumps are well known in the art for a wide variety of applications. Typically, such pumps include one or more plungers or pistons which reciprocate in a cylinder, compressing a fluid, such as liquid, in the cylinder and pumping the liquid therefrom.

Such piston or plunger pumps are characterized as constant speed, constant torque, nearly constant capacity devices. As such, the pumping capacity of piston pumps is very nearly predictable under most operating conditions for which the pump is designed.

In one typical configuration, the pump includes a cylinder formed in a pump housing. The cylinder is adapted to slidingly receive the piston. The housing includes opposingly oriented inlet and outlet ports generally transverse to the direction of reciprocation of the piston. Inlet and outlet valves are positioned at the inlet and outlet ports, respectively. Liquid is supplied to the pump through the inlet valve during the upstroke movement, i.e., the suction cycle, of the piston. As the piston reaches the top of stroke position, the inlet valve closes and the piston reverses direction and commences into the downstroke, i.e., the discharge cycle. As the piston moves downward into the cylinder, the fluid is pressurized and is thus forced or pumped out of the pump through the outlet valve.

It will be recognized by those skilled in the art that the pump internals are under pressure as the piston moves through the downstroke and are subjected to a lesser or negative pressure as the piston moves through the upstroke. Many such pumps are designed to use the upstroke movement, which creates a negative pressure in the pump housing, as a driving force for liquid supply or suction to the pump.

While the upstroke and downstroke movements provide relatively predictable negative and positive pressure profiles, respectively, the pressure profile as the piston reaches the top of stroke and bottom of stroke positions, i.e., the positions at which the piston changes direction, may not be as readily predictable in application. In particular, it has been observed that as the piston reaches the bottom of stroke position, the pressure profile exhibits a negative pressure characteristic in the fluid discharge stream which can effect the quantity of fluid discharged from the pump.

When the pump is used in a batch mode processing system, that is, a system in which discrete, predetermined amounts of liquid are to be pumped rather than a continuous liquid flow, such a negative pressure can result in a portion of the discrete fluid amount being retained in the outlet portion of the pump, or in the piping or nozzle immediately downstream of the pump. This is due, in part, to the outlet valve momentarily remaining open after the piston has stopped and the hydrodynamic flow characteristics of the liquid moving away from the pump.

The liquid retention can be particularly problematic when the pump is used for providing a predetermined, discrete amount of liquid into individual packages, for example, when the pump is used to fill food product packages, such as milk and juice packages and the like. It will be recognized that the retention of liquid food product in the pump outlet and filling nozzles immediately downstream of the pump is an undesirable condition.

A common package filling arrangement used in the liquid food product industry includes a product tank having one or more manifolds supplying product to a plurality of pump and nozzle assemblies, with each of the pump and nozzle assemblies filling the individual product packages. The pump and nozzle assemblies are typically constructed and calibrated to supply a precise amount of liquid product to each package within a specified tolerance. Typically, the tolerance will be in a range of about ±1 ml for packages up to about 2000 ml. In one currently used configuration, the manifold supplies five pump and nozzle assemblies, in series, from a common header.

It has been observed that identical pump and nozzle assemblies positioned so as to take supply from different points along the common header may not pump an identical quantity of liquid product. Thus, some of the individual packages may have more or less liquid than specified, and more or less liquid than other packages being simultaneously filled. Given the small tolerance ranges set by some of the food packagers, this inconsistency in filling quantity can become a concern.

It is believed that the filling inconsistencies are due, at least in part, to the differing piping flow resistances across the common header. It is also believed that such inconsistencies may also be due to a venturi effect across the piping connection to pump and nozzle assemblies which are not located at the beginning or end portions of the common header.

Accordingly, there continues to be a need for a pressure equalizing device for use with positive displacement, reciprocating type pumps. Such a pressure equalizing device should prevent the retention of liquid in the pump and associated discharge piping which may result from the negative pressure created by stopping of the piston and reversal of direction at the top of the upstroke and the bottom of the downstroke. Such a pressure equalizing device should also provide an adjustment capability to vary the equalizing volume and pressure in each pump, individually, to compensate for slight pressure variations along the supply piping to the pump.

SUMMARY OF THE INVENTION

A pressure equalizer for use with a pump for, for example, filling individual liquid food packages, provides a liquid accumulation region to facilitate precise control over the amount of liquid discharged from the pump, and provides a short duration pressure spike to facilitate complete discharge of the liquid from the pump and associated components.

In a typical packaging arrangement, a plurality of pumps take suction or are supplied from a common header. The header takes suction from a bulk liquid product tank. The pumps transfer the liquid from the tank to individual product packages. Generally, such a packaging system uses positive displacement, piston type pumps.

Each pump includes a pressure equalizer mounted to the pump head in fluid communication with the pump internal, pressurized region. Each equalizer includes a housing which is mounted to the pump in a leak-tight manner.

A variable volume arrangement having a biased isolation member is carried by the equalizer housing and is in fluid communication with the pump pressure region. The isolation member is adapted to expand outwardly of the pressure region and contract inwardly of the pressure region in conjunction with an increase and a decrease in pressure in the pressure region. Each the outward expansion and the inward contraction are within a predetermined range of movement. In a preferred configuration, the isolation member is a flexible diaphragm.

The equalizer includes a retaining member which is engageable with the diaphragm, and at least one biasing element positioned on the retaining member, operably connected to the diaphragm. The biasing element is adjustable for setting the outward expansion range of movement of the diaphragm, and the inward contraction range of movement of the diaphragm.

In a preferred embodiment, the equalizer includes two biasing elements. One of the biasing elements is adjustable to set the outward expansion range of movement of the diaphragm. The other biasing element is adjustable to set the inward contraction range of movement of the diaphragm. Preferably, the first and second biasing elements are independently adjustable relative to one another.

The diaphragm expands into the equalizer housing within the preset range of movement in response to a pressure increase in the pump. The expanded diaphragm condition defines an accumulation region for accumulating a predetermined amount of liquid therein. The diaphragm contracts into the pressure region, within the preset range of movement, in response to a pressure decrease in the pump to discharge the accumulated liquid therefrom and to provide a positive pressure within the pump to fully discharge the liquid from the pump and associated components.

In a most preferred configuration, the equalizer includes a first adjusting member engageable with the housing for adjusting, e.g., compressing, the first biasing element to preset the contraction range of movement of the diaphragm. A second adjusting member is engageable with the first adjusting member for adjusting, e.g., compressing the second biasing member to preset the expansion range of movement of the diaphragm. In a current embodiment, the biasing members are coil springs.

An alternate embodiment of the equalizer includes a retaining member having a single biasing member thereon which is adapted to adjustably set the outward expansion range of movement of the diaphragm and the inward contraction range of movement of the diaphragm.

The alternate embodiment includes a first adjusting member engageable with the equalizer housing and operably connected to the retaining member. The adjusting member is configured to coact with the biasing element to preset the expansion and contraction ranges of movement of the diaphragm. The alternate embodiment can include a first adjusting member configured to compress the biasing element and a second adjusting member engageable with the first adjusting member to preset the range of movement of the retaining member in engagement with the diaphragm.

Other features and advantages of the present invention will be apparent from the following detailed description, the accompanying drawings, and the appended claims.

DETAILED DESCRIPTION OF THE PREFERRED EMBODIMENTS

Figure 1:
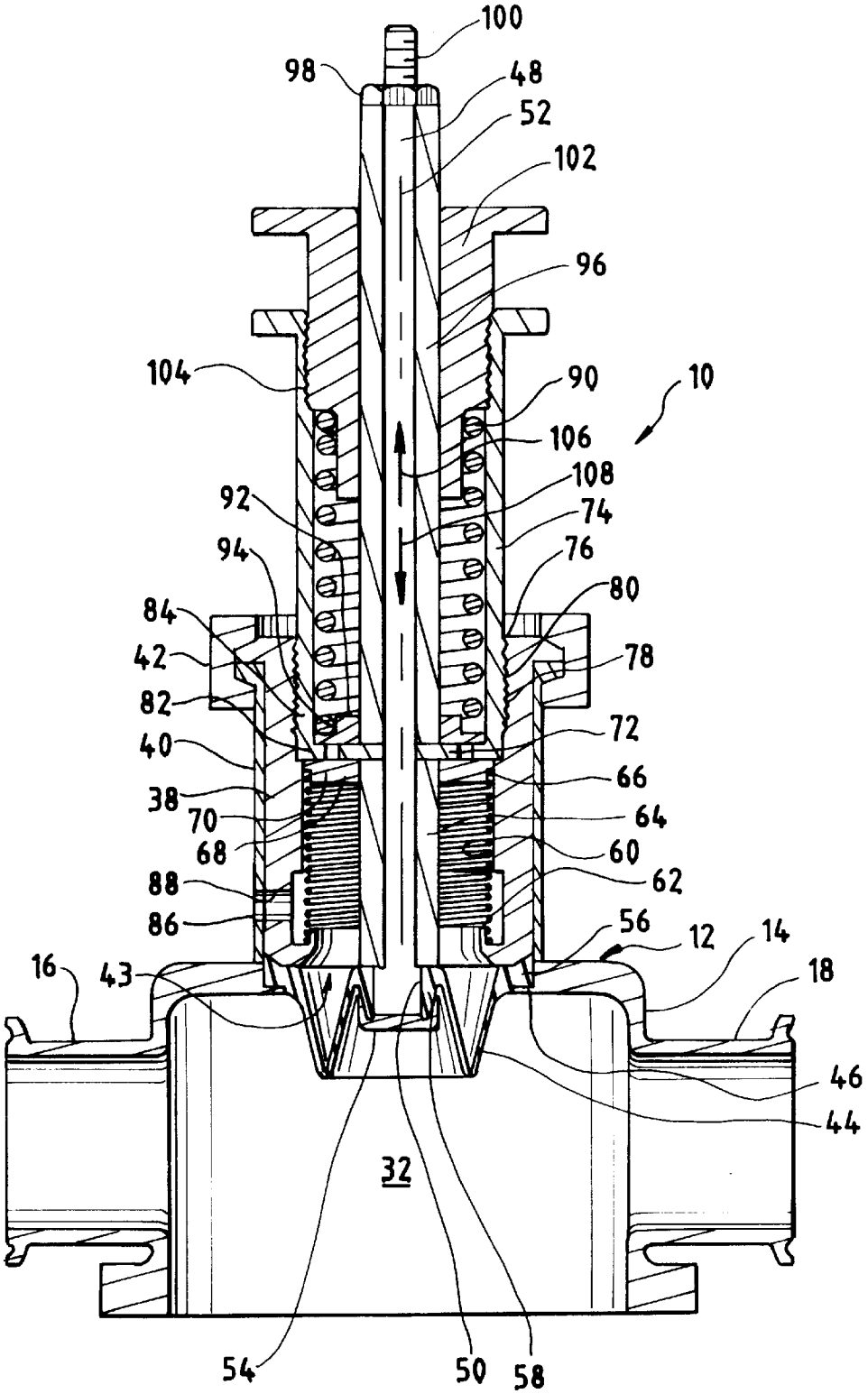
FIG. 1 is a cross-sectional view of a pump head pressure equalizer embodying the principles of the present invention, illustrated mounted to the head portion of a reciprocating piston-type pump, showing the inlet and outlet ports thereof.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

With reference now to the figures, and in particular to FIG. 1, there is shown a pump head pressure equalizer 10 in accordance with the principles of the present invention. The equalizer 10 is illustrated mounted to the head portion 12 of a pump 14 body or housing. The portion of the pump 14 shown is illustrated with suction and discharge ports 16, 18, respectively.

Figure 4:
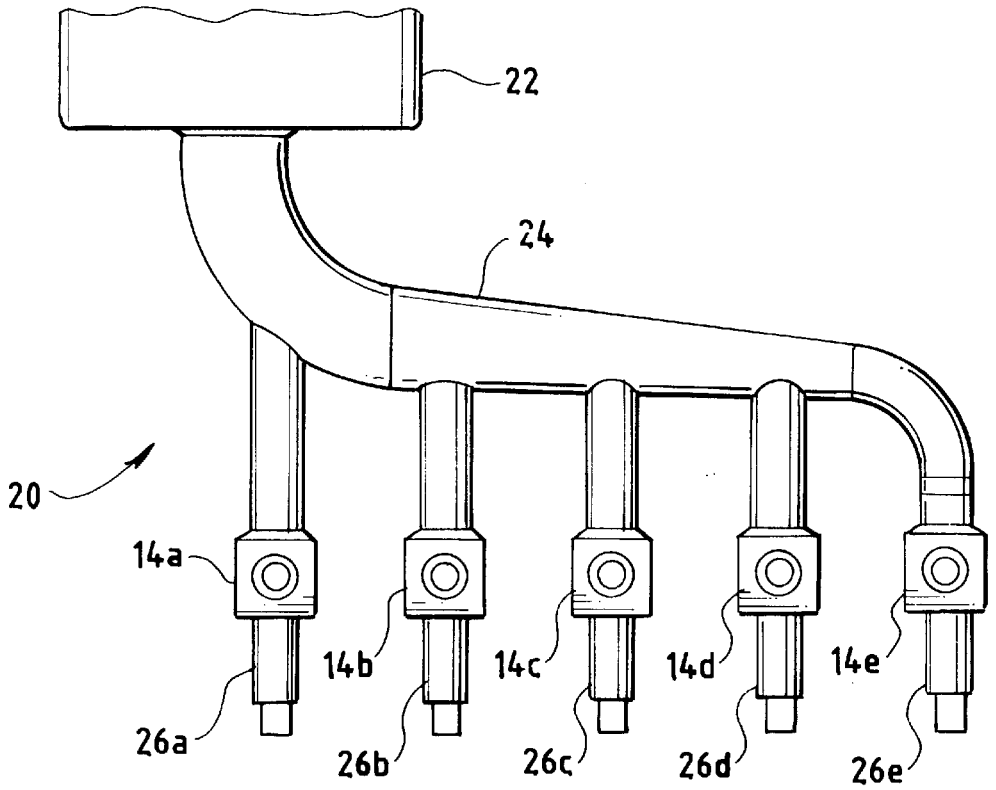
FIG. 4 is an illustration of a plurality of pumps having head pressure equalizers mounted to each pump, and being illustrated in a typical arrangement with the pumps supplied from a common supply header.

In a typical food product packaging system 20, an example of which is illustrated in FIG. 4, a bulk supply tank 22 stores food product for transferring to individual product packages (not shown). One or more piping manifolds or headers 24 take suction from the supply tank 22. A plurality of pumps 14*a–e* are connected to and take suction from the header 24. The pumps 14*a–e* pump a predetermined, precisely controlled amount of liquid into the individual packages through filling nozzles 26. The system 20 can be automatically monitored and controlled, by, for example, an automated control system (not shown). In a typical configuration, the pumps 14*a–e* are reciprocating, piston type pumps.

The pump 14, the operation of which will be described herein, includes a reciprocating piston 28 (FIGS. 2*a,b*–3*a,b*) positioned in the body. The piston 28 reciprocates in a piston cylinder 30. The portion or region of the pump 14 into which the liquid is drawn and from which the liquid is pumped defines a pressure region 32. The piston 28 may be isolated from contact with the pressure region 32 by a diaphragm or like flexible sealing member 34, as shown in FIGS. 2*a,b* and 3*a,b*.

The sealing member 34 prevents the pumped liquid from contacting the piston 28 and cylinder 30 surfaces. The seal member 34 isolates the liquid from the contacting pump 14 surfaces, thereby reducing the opportunity for contamination of the liquid.

The pump 14 includes non-return type suction and discharge valves (not shown) at the suction and discharge ports, 16, 18, respectively. The valves may be spring biased or float type check valves which permit unidirectional flow of the liquid into or out of the pump 14. Such valves and their particular applications will be readily recognized by those skilled in the art.

Figure 2A:
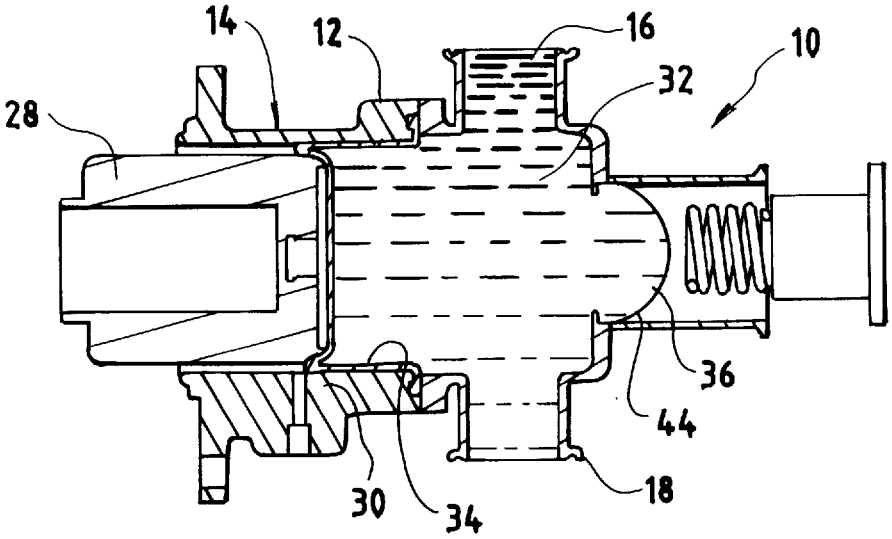
FIGS. 2*a* and 2*b* are illustrations of the pump and equalizer, showing the pump during the suction (FIG. 2*a*) and discharge (FIG. 2*b*) strokes or phases of the pumping cycle, and the response of the diaphragm during the cycle strokes, the diaphragm being set for a relatively large accumulation volume.
Figure 2B:
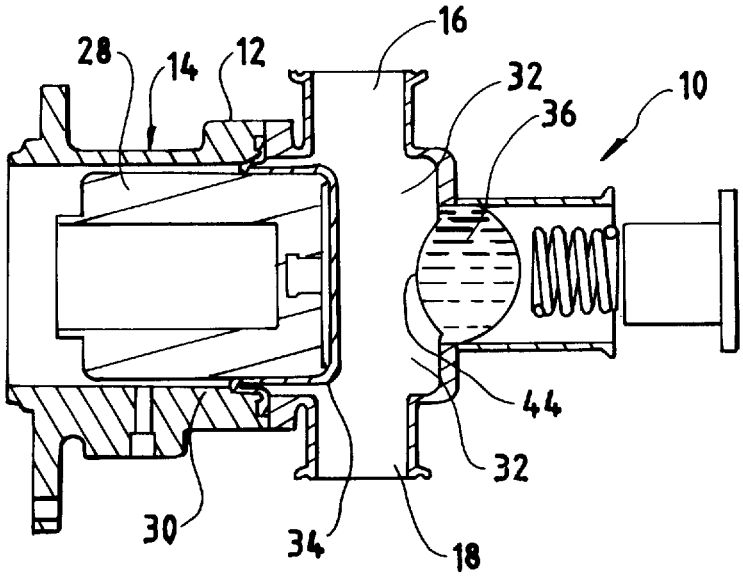
Figure 3A:
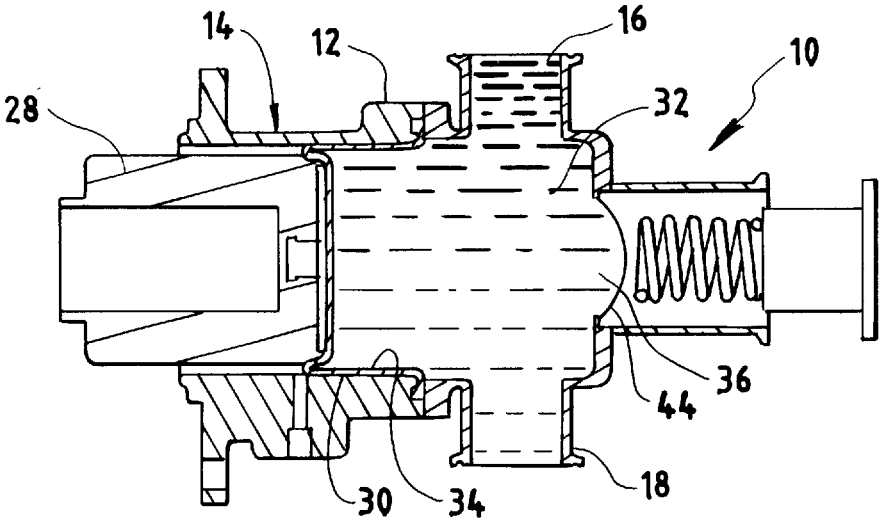
FIGS. 3*a* and 3*b* are illustrations similar to FIGS. 2*a* and 2*b*, showing the pump and equalizer during the suction (FIG. 3*a*) and discharge (FIG. 3*b*) strokes with the diaphragm set for a smaller accumulation volume.
Figure 3B:
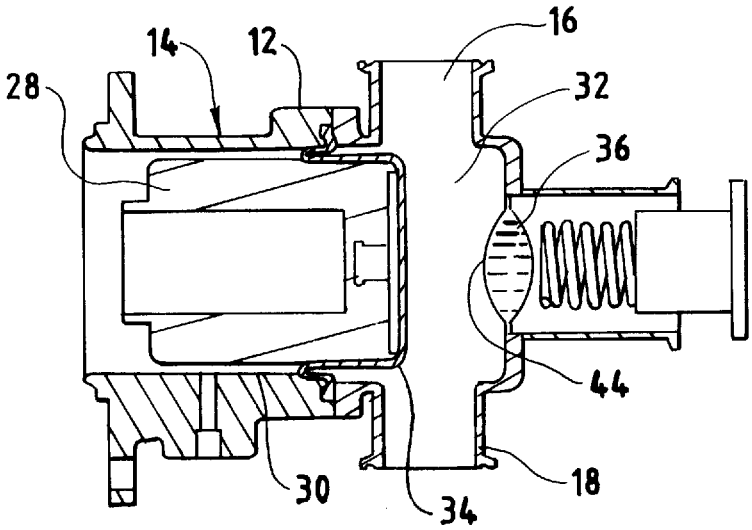

The piston 28 reciprocates between a suction stroke, as illustrated in FIGS. 2*a* and 3*a*, and a discharge stroke, as illustrated in FIGS. 2*b* and 3*b*. During the suction stroke, the piston 28 moves so as to increase the volume of the pressure region 32. Consequently, the pressure in the pressure region 32 is lower than the liquid supply, and the liquid is drawn into the pump 14. Conversely, during the discharge stroke, the piston 28 moves so as to decrease the volume of the pressure region 32. The force of the piston 28 moving into the pressure region 32 increases the pressure on the liquid and liquid is pushed or propelled from the pump 14.

The head pressure equalizer 10 of the present invention is mounted to the pump 14, in fluid communication with the pump pressure region 32. In a current embodiment, the equalizer 10 is mounted in opposing relation to the piston 28, intermediate the suction and discharge ports 16, 18. The equalizer 10 is configured to accumulate an amount of the pumped liquid therein, in an accumulation region 36, as the pressure in the pump 14 increases. The accumulated liquid is discharged from the accumulation region 36 into the pressure region 32 as the pressure in the pump 14 decreases.

The equalizer 10 can be used to precisely adjust the amount of liquid pumped into each of the individual product packages by adjusting the volume of the accumulation region 36. The equalizer 10 may also be used to provide a short duration application or spike of positive pressure into the pressure region 32 to facilitate fully discharging or pumping the liquid from the pump 14 and associated downstream components (e.g., filling nozzles 26).

The equalizer 10 has a body or housing 38 which is engageable with, and in a preferred embodiment, clamped to, the pump 14 body. As illustrated in FIG. 1, the equalizer 10 is inserted into a sleeve 40 in the pump 14 body, and a clamp 42 is positioned around the equalizer housing 38 and the sleeve 40 to fixedly mount the equalizer 10 to the pump 14 body. The clamp 42 facilitates establishing a leak-tight seal between the pump 14 and the housing 38. The equalizer 10 includes a variable volume arrangement 43, including an isolation member 44, such as the exemplary flexible diaphragm, positioned at an end thereof, between the housing 38 and the pump 14 body. The isolation member 44 is essentially sandwiched between the housing 38 and a retaining flange 46 extending inwardly of the sleeve 40. As will be described herein, the isolation member 44 flexes to provide a volume for accumulation and discharge of liquid during the pumping cycle.

The diaphragm 44 is configured and is mounted to the housing 38 to flex inwardly and outwardly of the pressure region 32. As used herein, the terms outwardly expanded, expansion or outward extended, when used in reference to the state of the diaphragm 44, mean flexure of the diaphragm 44 outwardly of the pressure region 32 (and inwardly of the equalizer housing 38), as illustrated in FIGS. 2*a* and 3*a*. Conversely, the terms inwardly contracted, contraction or inwardly extended, mean flexure of the diaphragm 44 inwardly of the pressure region 32 (and outwardly of the equalizer housing 38), as illustrated in FIGS. 2*b* and 3*b*. It will be recognized by those skilled in the art that the outwardly expanded diaphragm 44 condition increases the volume of the pressure region 32 and that the inwardly contracted diaphragm 44 condition decreases the pressure region 32 volume. The expanded diaphragm 44 condition defines the accumulation region 36.

The equalizer 10 includes an elongated, rod-like retaining member 48 extending through a central opening 50 in the diaphragm 44. The retaining member 48 passes through about a center axis, as illustrated by the arrow at 52, of the equalizer 10, and has a seal cap 54 at an end thereof which engages the diaphragm 44 at the central opening 50. The seal cap 54 coacts with the diaphragm 44 to form a seal between the retaining member 48 and the diaphragm 44. As best seen in FIG. 1, the diaphragm 44 has thickened outer and inner peripheral end portions, 56 and 58, respectively, where the diaphragm 44 is positioned between the housing 38 and the retaining flange 46, and where the retaining member 48 penetrates and is secured to the diaphragm central opening 50. The thickened portions 56, 58 provide additional structural strength to the diaphragm 44 to withstand the forces exerted thereon by the pressure fluctuations in the equalizer 10 and the resulting flexure of the diaphragm 44.

A first biasing element 60, such as the exemplary coil spring, is positioned in the housing 38 and facilitates adjustably setting the inward range of travel of the retaining member 48 and the diaphragm 44. The spring 60 is positioned in the housing 38, abutting a spring retaining lip 62. The equalizer 10 includes a plurality of washers and sleeves to adjust the compression on the spring 60. A first sleeve 64 is positioned around the retaining member 48 shaft, abutting the diaphragm 44 at about the central opening 50. The pressure exerted by the sleeve 64 on the diaphragm 44 at the seal cap 54, in part, establishes the seal between the retaining member 48 and the diaphragm 44. The end of the spring 60 opposite of the retaining lip 62 is held in place by a first spring seat 68. The spring seat 68 has a shoulder portion 70 which permits a portion of the seat 68 to reside inside of the spring 60 to secure the spring 60 in place, and to axially and radially align the spring 60 with the housing 38. A compression ring 72 is positioned on the retaining member 48 extending over and abutting the sleeve 64 and a portion of the spring seat 68.

The equalizer 10 includes a first adjusting member 74 which is adapted to threadedly engage the housing 38 to adjust or vary the compression on the first spring 60. The adjusting member 74 includes a thread formation 76 on an outer surface of a sleeve-like member 78 which is adapted to engage a thread formation 80 on an inner surface of the housing 38. The adjusting member 74 includes an inwardly extending lip 82, extending from a lower portion 84 thereof. The lip 82 is configured to engage the spring seat 68 and secure the spring 60 inside of the housing 38.

As will be seen from FIG. 1, as the adjusting member 74 is threaded into the housing 38, the spring 60 is compressed between the retaining lip 62 and the spring seat 68. The effect of compressing the spring 60 on the inward travel of the diaphragm 44 will be more fully described herein. The sleeve 64 and the first adjusting member 74 may each include vent openings 86, 88 which align with one another. The vent openings 86, 88 provide venting to the space within the first adjusting member 74 so that the space remains at atmospheric pressure to prevent extraneous flow and thermally induced pressure forces from acting on the diaphragm 44.

A second biasing element 90 is positioned in the sleeve portion 78 of the first adjusting member 74, and rests on a second spring seat 92. The second spring seat 92 is positioned in the first adjusting member 74 abutting the lip 62 and the compression ring 72. The second seat 92 provides a seating surface for the second spring 90 and retains the spring 90 in axial and radial alignment with the first adjusting member 74 and the retaining member 48. The second spring seat 92 includes a shoulder region 94 which, like the first seat 68, permits a portion of the seat 92 to reside inside of the second spring 90 to axially and radially align the spring 90 in the equalizer housing 38.

A second sleeve 96 is positioned around the retaining member 48 shaft, collinear with and generally extending from the first sleeve 64. A locking element 98 is positioned on the retaining member 48 to retain the second sleeve 96 in place. In a preferred arrangement, the retaining member 48 includes a threaded portion 100 and the locking element 98 is a threaded locking nut.

A second adjusting member 102 is positioned in the first adjusting member 74 so as to facilitate compressing the second spring 90. Preferably, the outer surface of the second adjusting member 102 is threadedly engaged with a corresponding thread formation 104 in the inner surface of the first adjusting member 74.

The present configuration of the equalizer 10 provides variable adjustment of the diaphragm 44, and particularly independently settable compressive and expansive adjustment of the diaphragm 44 through the dual spring 60, 90 arrangement. The first spring 60, which is adjusted in compression by the first adjusting member 74 permits varying the inward range of travel of the diaphragm 44. That is, by varying the compression of the first spring 60, the amount of inward travel of the diaphragm 44 (the distance the diaphragm 44 travels when the pressure in the pump pressure region 32 is less than the adjacent piping sections) can be varied relative to the pressure in the pressure region 32. For example, with the spring 60 compressed to a particular compressive force, the diaphragm 44 will travel inward of the pressure region 32 when the pressure region is at a negative pressure. When the spring 60 is further compressed, i.e., increasing the compression of the spring 60, the inward range of travel of the diaphragm 44 is commensurately reduced at an equivalent low or negative pressure in the pressure region 32.

The outward range of travel of the diaphragm 44 can be likewise varied, independent of the setting of the first spring 60. The outward range of travel is varied by increasing or decreasing the compression of the second spring 90, by tightening or loosening the second adjusting member 102 accordingly. For example, as the compression on the second spring 90 is increased, the outward range of travel of the diaphragm 44 is reduced relative to an equivalent positive pressure in the pressure region 32. This is illustrated by comparison of the outward amount of travel of the diaphragm 44 depicted in FIGS. 2*a* and 3*a*, wherein it is shown that increased compression of the spring 90 (FIG. 3*a*) reduces the range of travel of the diaphragm 44.

In use, the equalizer 10 is mounted to the pump 14, as illustrated in FIG. 1. The nut 98 is tightened down on the retaining member 48 accordingly to place the retaining member 48 in tension. The first adjusting member 74 is threaded into the housing 38 to provide a desired inward range of travel for contraction of the diaphragm 44. Likewise, the second adjusting member 102 is threaded into the first adjusting member 74 to provide a desired outward range of travel for expansion of the diaphragm 44.

Referring to FIG. 1, as the pressure in the pressure region 32 increases, the diaphragm 44 is urged to the expanded condition, and the retaining member 48 is forced upwardly as indicated by the arrow at 106. The first sleeve 64 is likewise forced upward which in turn forces the compression ring 72 and the second spring seat 92 upward, against the force of the second spring 90. The amount that the diaphragm 44 travels is limited by, and is proportional to, the preset compression on the second spring 90.

Conversely, as the pressure in the pressure region 32 decreases, the diaphragm 44 is urged to the contracted condition, and the retaining member 48 is forced downward as indicated by the arrow at 108. The sleeves 64, 96 are likewise forced downward which in turn forces the compression ring 72 and the first spring seat 68 downward, against the force of the first spring 60. The amount that the diaphragm 44 travels is limited by, and is proportional to, the preset compression on the first spring 60.

When the pump 14 is in operation, as the piston 28 reciprocates between the suction and discharge strokes, the diaphragm 44 reciprocates between the contracted and expanded conditions. When the piston 28 reaches the top of suction stroke, as illustrated in FIG. 2*a*, the diaphragm 44 responds to the increase in pressure in the pressure region 32 and expands to establish the accumulation region 36 for liquid in the concave portion of the expanded diaphragm 44. As the piston 28 cycles through the discharge stroke and reaches the bottom of the discharge stroke, the diaphragm 44 responds to the drop in pressure in the pressure region 32 and contracts to discharge the liquid which accumulated in the accumulation region 36.

For purposes of the present disclosure, the point of the suction stroke at which the volume of the pressure region 32 is greatest is referred to as the top of the suction stroke. Conversely, the point of the discharge stroke at which the volume of the pressure region 32 is smallest is referred to as the bottom of the discharge stroke. The top and bottom designations are for reference and convenience only. It should not be inferred, nor is it implied that the top and bottom references designate any particular orientation.

Advantageously, the present equalizer 10 provides independent adjustment of the springs 60, 90 to independently establish the range of travel of the diaphragm 44 in the expanded and contracted conditions. The independent, dual position adjustment permits the second spring 90 to be adjusted to provide a precise amount of liquid to accumulate in the accumulation region 36. This provides refined, precise control of the final product amount that is discharged to the individual product packages. Control is accomplished by adjusting the outward expansion range of travel of the diaphragm 44 to a desired accumulation amount, consequently establishing and limiting the amount of liquid that can accumulate during the pumping cycle. The inward contraction of the diaphragm 44 is likewise set to discharge the liquid in the accumulation volume 36 and to provide a short duration positive pressure in the pump 14 following liquid discharge.

One benefit to independently setting the range of contraction and expansion of the diaphragm 44 is that the accumulated liquid volume can be adjusted independently of the pressure required to create a positive pressure, or at the least, atmospheric pressure in the pump 14 immediately following discharge of the liquid. As provided previously, at the bottom of stroke during discharge, the pressure region 32 may exhibit an instantaneous condition or spike of negative pressure. This can result in less than complete discharge of the liquid from the pump 14 and associated downstream components (e.g., filling nozzles 26). That is, the negative pressure condition may result in retaining liquid in the various components.

It will be readily recognized by those skilled in the art that it is undesirable to have liquid retained in the pump 14 and components for various reasons. One drawback to liquid retention is that it reduces the control over the final product volume discharged into each package. As provided herein, the present equalizer 10 overcomes problems previously unresolved in known filling pumps by providing a short duration positive pressure spike to fully discharge liquid from the pump 14 and components. Moreover, the present head pressure equalizer 10 resolves these problems in a device which is compact in size, and which is readily installed on reciprocating pumps. The present equalizer 10 configuration is further enhanced by its simplicity of design and ease of maintenance and adjustment.

Advantageously, because the present equalizer 10 is mounted to each individual pump 14*a–e*, as illustrated in FIG. 4, the accumulation region 36 volume can be set for each pump and nozzle assembly 14*a–e*, 26*a–e*, to discharge the desired amount of liquid food product to each of the individual packages.

Figure 5:
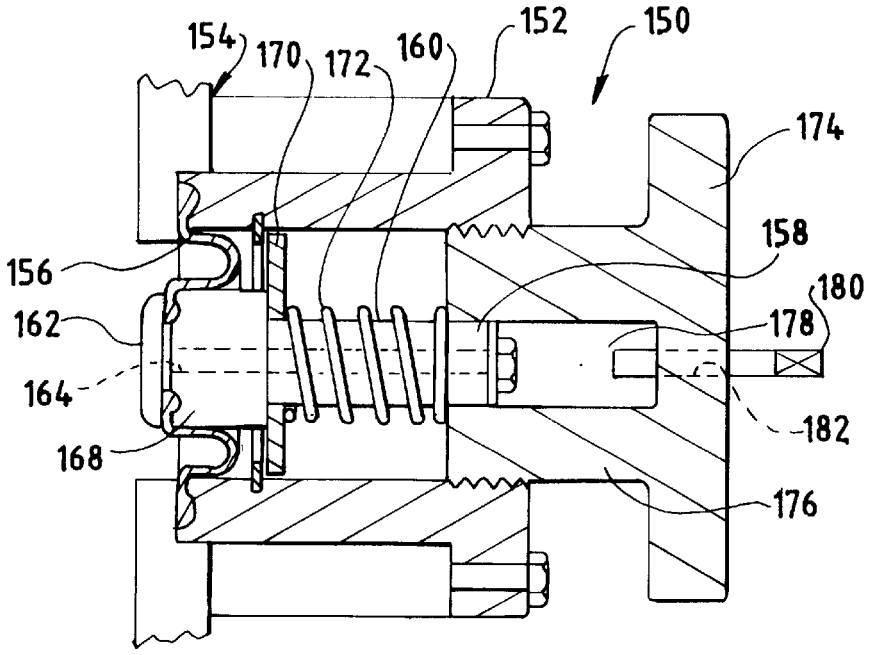
FIG. 5 illustrates an alternate embodiment of the pump having a single biasing element for establishing the accumulation volume.

An alternate embodiment of the equalizer 150 is illustrated in FIG. 5. The alternate embodiment 150 includes a housing 152 that is mountable to the pump 154 body. An isolation member 156, such as the exemplary flexible diaphragm, extends across the housing 152, intermediate the housing 152 and the pump 154 body. A retaining member 158 having a shaft 160 and a seal cap 162 extends through an opening 164 in the diaphragm 156 inward of the housing 152. The seal cap 162 is positioned abutting the diaphragm 156. A spacer 168 is positioned on the retaining member shaft 160 with the diaphragm 156 intermediate the seal cap 162 and the spacer 168. A sliding spring seat 170 is positioned on the retaining member shaft 160 in abutting relation to the spacer 168.

A biasing element 172, such as a coil spring is positioned on the shaft adjacent 160 to the sliding seat 170. The equalizer 150 includes a first adjusting member 174, which, preferably, is threadedly engageable with the housing 152. The adjusting member 174 includes an outer, annular portion 176 defining an open central region 178. The outer annular portion 176 is adapted to engage and compress the spring 172 while the shaft 160 moves or reciprocates in the open central region 178.

A second pin-like adjusting member 180 extends through an opening 182 in the first adjusting member 174, into the open central region 178. The second adjusting member 180 is adapted to coact with the retaining member shaft 160, to limit the travel thereof, and thus to limit expansion of the diaphragm 156. Limiting expansion of the diaphragm 156 controls the volume of the accumulation region.

In use, the equalizer 150 is positioned on the pump 154 body. The first adjusting member 174 is threaded into the housing 152 to compress the spring 172, which sets the force required to expand and contract the diaphragm 156. The second adjusting member 180 is threaded into the first member 174 to set the maximum expansion of the diaphragm 156.

The diaphragm 156 of the alternate embodiment 150 responds to pressure changes in the pressure region in the same manner as the embodiment 10 illustrated in FIG. 1. As the pressure in the pressure region increases, the diaphragm 156 expands to establish the accumulation region. The volume of the accumulation region is determined by the amount of travel of the shaft 160 and the diaphragm 156, as limited by the second adjusting member 180. As the pressure in the pressure region decreases, the diaphragm 156 contracts which discharges the accumulated liquid from the accumulation region and provides a positive pressure spike to the pressure region to fully discharge the liquid from the pump 154 and associated components.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A pressure equalizer for use with a reciprocating pump, the pump having a body defining a pressure region in fluid communication with a reciprocating piston, the piston reciprocating between a discharge stroke wherein the pressure region is subjected to an increased pressure therein and a suction stroke wherein the pressure region is subjected to a decreased pressure therein, the pump including an inlet port for fluid suction and a discharge port for discharging the pumped fluid therefrom, the pressure equalizer comprising:

an equalizer housing mountable to the pump body, the equalizer housing being in fluid communication with the pressure region;

a variable volume assembly carried by the equalizer housing, the variable volume assembly including an isolation member in fluid communication with the pressure region, the isolation member being adapted to expand outwardly of the pressure region and contract inwardly of the pressure region in conjunction with the increase and decrease in pressure in the pressure region, each the outward expansion and inward contraction being within a predetermined range of movement;

a retaining member engagable with the isolation member; and a first biasing element positioned on the retaining member operably connected to the isolation member for adjustably setting the inward contraction range of movement of the isolation member, and a second biasing element positioned on the retaining member in spaced relation to the first biasing element, the second biasing element being operably connected to the isolation member for adjustably setting the outward expansion range of movement of the isolation member, wherein the isolation member expands outwardly of the pressure region within the range of movement in response to an increase of pressure in the pressure region to accumulate a predetermined amount of liquid, and wherein the isolation member contracts inwardly of the pressure region within the range of movement in response to a decrease of pressure in the pressure region to discharge a predetermined amount of accumulated liquid.

2. The pressure equalizer in accordance with claim 1 including a first adjusting member engageable with the housing and operably connected to the retaining member, the adjusting member being configured to coact with one of the first and second biasing elements to preset one of the expansion and contraction ranges of movement of the isolation member.

3. The pressure equalizer in accordance with claim 2 including a second adjusting member engageable with the first adjusting member and operably connected to the retaining member, the second adjusting member being configured to coact with the other of the first and second biasing elements to preset the other of the expansion and contraction ranges of movement of the isolation member.

4. The pressure equalizer in accordance with claim 1 wherein at least one of the first and second biasing elements is a coil spring.

5. The pressure equalizer in accordance with claim 4 including a spring seat adapted to maintain the at least one coil spring in radial alignment with the housing.

6. The pressure equalizer in accordance with claim 1 wherein the housing includes a vent opening therein.

7. The pressure equalizer in accordance with claim 1 wherein the isolation member is a flexible diaphragm.

8. A pressure equalizer for use with a reciprocating pump, the pump having a body defining a pressure region in fluid communication with a reciprocating piston, the piston reciprocating between a discharge stroke wherein the pressure region is subjected to an increased pressure therein and a suction stroke wherein the pressure region is subjected to a decreased pressure therein, the pump including an inlet port for fluid suction and a discharge port for discharging the pumped fluid therefrom, the pressure equalizer comprising:

an equalizer housing mountable to the pump body, the equalizer housing being in fluid communication with the pressure region;

an isolation member carried by the equalizer housing and in fluid communication with the pressure region, the isolation member being adapted to expand outwardly of the pressure region and contract inwardly of the pressure region in conjunction with the increase and decrease in pressure in the pressure region, each the outward expansion and inward contraction being within a predetermined range of movement;

a retaining member engageable with the isolation member; and at least one biasing element positioned on the retaining member operably connected to the isolation member for adjustably setting the outward expansion range of movement of the isolation member, and for adjustably setting the inward contraction range of movement of the isolation member, wherein the isolation member expands outwardly of the pressure region within the range of movement in response to an increase of pressure in the pressure region to accumulate a predetermined amount of liquid, and wherein the isolation member contracts inwardly of the pressure region within the range of movement in response to a decrease of pressure in the pressure region to discharge a predetermined amount of accumulated liquid.

9. The pressure equalizer in accordance with claim 8 wherein the at least one biasing element is a coil spring.

10. The pressure equalizer in accordance with claim 8 including a first adjusting member engageable with the housing and with the retaining member, the adjusting member being configured to coact with the at least one biasing element to preset at least one of the expansion and contraction ranges of movement of the isolation member.

11. The pressure equalizer in accordance with claim 10 including a second adjusting member engageable with the first adjusting member to preset the other of the expansion and contraction ranges of movement of the isolation member.

12. The pressure equalizer in accordance with claim 10 wherein the adjusting member includes an outer annular portion defining an inner open central region adapted to receive the retaining member, the outer annular portion being configured to engage and compress the biasing element independent of the retaining member to, at least in part, preset the at least one of the expansion and contraction ranges of movement of the isolation member.

13. The pressure equalizer in accordance with claim 12 including a second adjusting member engageable with the first adjusting member to, at least in part, preset the other of the expansion and contraction ranges of movement of the isolation member.

14. The pressure equalizer in accordance with claim 8 wherein the isolation member is a flexible diaphragm.

15. A pressure equalizer for use with a pump defining a pressure region which is subjected to cyclical increases and decreases in pressure, comprising:

a housing mountable to the pump;

an adjustable isolation member carried by the housing positioned intermediate the housing and the pump in fluid communication with the pressure region, the isolation member being adapted to outwardly and inwardly flex, relative to the pump, in response to the cyclical increases and decreases of pressure, respectively, in the pressure region; and at least one biasing element operably connected to the isolation member and being compressible to adjustably limit the outward and inward flexure of the isolation member, wherein in response to a pressure increase in the pressure region, the isolation member flexes outwardly of the pressure region to define an accumulation region for accumulating liquid therein, and in response to a pressure decrease in the pressure region, the isolation member flexes inwardly of the pressure region to subject the pressure region to a pressure at least equal to atmospheric pressure.

16. The pressure equalizer in accordance with claim 15 including two biasing elements, wherein one of the biasing elements is compressible to limit the outward flexure of the isolation member and the other of the biasing elements is compressible to limit the inward flexure of the isolation member.

17. The pressure equalizer in accordance with claim 15 wherein the at least one biasing element is a coil spring.

18. The pressure equalizer in accordance with claim 16 wherein the two biasing elements are coil springs.

19. The pressure equalizer in accordance with claim 15 including at least one adjusting member, each of the at least one adjusting members being associated with a respective one of the at least one biasing elements.

20. The pressure equalizer in accordance with claim 19 including two biasing elements, the biasing elements being coil springs, the equalizer including two adjusting members, each of the adjusting members being adapted to compress a respective one of the coil springs independently of the other coil spring.

21. The pressure equalizer in accordance with claim 15 wherein the isolation member is a flexible diaphragm.

* * * * *